US011053043B2

(12) United States Patent
Segerstam

(10) Patent No.: US 11,053,043 B2
(45) Date of Patent: Jul. 6, 2021

(54) METHOD AND ARRANGEMENT FOR EMPTYING A FLEXIBLE CONTAINER

(71) Applicant: Fluid-Bag Ltd, Jakobstad (FI)

(72) Inventor: Henry Segerstam, Jakobstad (FI)

(73) Assignee: FLUID-BAG LTD, Jakobstad (FI)

( * ) Notice: Subject to any disclaimer, the term of this patent is extended or adjusted under 35 U.S.C. 154(b) by 0 days.

(21) Appl. No.: 16/670,379

(22) Filed: Oct. 31, 2019

(65) Prior Publication Data

US 2020/0140134 A1 May 7, 2020

(30) Foreign Application Priority Data

Nov. 6, 2018 (FI) ..... 20185939

(51) Int. Cl.
*B65B 69/00* (2006.01)
*B67D 7/02* (2010.01)

(52) U.S. Cl.
CPC ..... *B65B 69/005* (2013.01); *B65B 69/0075* (2013.01); *B67D 7/0216* (2013.01)

(58) Field of Classification Search
CPC .. B65B 69/005; B65B 69/0075; D67D 7/0216
USPC ..... 222/104, 99, 100, 214, 213, 105, 106, 222/181.1, 181.2, 182, 504, 516, 519
See application file for complete search history.

(56) References Cited

U.S. PATENT DOCUMENTS 1,959,365 A * 5/1934 Jeffreys ..... B65D 35/28 222/104
2,502,918 A * 4/1950 Beresford ..... B65D 83/0066 222/104
10,150,608 B2 * 12/2018 Witcher ..... B05C 17/0133

FOREIGN PATENT DOCUMENTS

| | | |
|---|---|---|
| CN | 107 697 486 | 2/2018 |
| DE | 101 57 800 | 6/2003 |
| DE | 10164029 | 7/2003 |
| EP | 1625093 | 2/2006 |
| EP | 1831099 | 9/2007 |
| ES | 2 717 378 | 6/2019 |
| WO | WO 03074366 | 9/2003 |
| WO | WO 2011/080402 | 7/2011 |

* cited by examiner

*Primary Examiner* — Lien M Ngo
(74) *Attorney, Agent, or Firm* — Leason Ellis LLP

(57) ABSTRACT

The present invention relates to a method and an arrangement for emptying a flexible container (30) of bag contents (31) therein. Such a flexible container includes a bottom opening (34) in its lower end and a top opening (37) in its upper end. When this container is to be emptied of its contents, it is placed in an emptying arrangement in such a way that the container's bottom opening lies below the top opening. The flexible container is then turned around an axis of rotation that unites said bottom opening and top opening. The turning motion produced is gradually propagated from the container's upper end towards its lower end whereby the container is twisted into a tight string (32). This twisting contributes to removing the bag contents (31) from the flexible container via the bottom opening (34) provided or made therein.

7 Claims, 3 Drawing Sheets

METHOD AND ARRANGEMENT FOR EMPTYING A FLEXIBLE CONTAINER

TECHNICAL AREA

The present invention relates to a method for emptying a flexible container according to the ingress to patent claim 1. In particular, such a method is used for emptying the material stored in a flexible transport bag or big bag (a so-called flexible intermediate bulk container—FIBC).

The present invention also relates to an emptying arrangement according to the ingress to patent claim 5. Using such an arrangement, a flexible container is advantageously emptied of its stored material via a bottom opening in, or made in, the container.

PRIOR ART

The transporting and storing of various types of, amongst other things, viscous materials in various containers of a fixed or variable shape is well known. Said containers may be, for example, barrels or bags, each in various materials or combinations of materials.

Bags, in particular, have previously been emptied using gravity. However, this arrangement is relatively slow and uncertain, especially when the material is viscous or of a thereto comparable nature. As the container can rarely be emptied without an aid, various forms of mangle and pump apparatuses, as well as combinations of these, have been developed.

There are a number of examples of mangle apparatuses on the market. In this context, such an apparatus is illustrated by European patent publication EP 1 625 093. Said apparatus includes two parallel rollers that are arranged to lie against the opposite walls of a flexible, bag-like container. Emptying of the flexible container can be facilitated by pressing the rollers towards each other and, at the same time, displacing them along an imaginary vertical axis in a direction towards the container's bottom opening. An improvement of this design is shown in publication WO2011/080402 where the earlier smooth rollers are replaced by toothed rollers.

Unfortunately, the presently used emptying arrangements have all proved to suffer the same problem. The material it is sought to empty from the container often leaves behind a thin or thick coating on the container's walls and on the walls of the discharge spout connected to the container. It is generally calculated that the material that is left behind, and of which the user is deprived, comprises 1-5% of the total amount of material transported or stored in the container. Thus, the material left behind is of great economic significance and many different solutions have been tried for minimising the percentage left behind when emptying containers.

For example, to improve emptying, the use of a pump apparatus connected to the container's discharge spout, which latter is generally pre-mounted on the container's lower end, has been tried—see, for example, EP1831099. Using such pump apparatuses, material can be sucked from the container relatively well. Unfortunately, it is often necessary to interrupt emptying prematurely because the pump apparatus cannot be fed with sufficient material. Thus, on completion of an emptying, material is always left behind stuck to the flexible container's walls.

PRESENTATION OF THE PROBLEM

Using the present invention, the problems affecting known solutions can essentially be avoided, thereby achieving better and, at the same time, faster emptying of the flexible containers.

The foregoing is achieved by the method for emptying a flexible container having, according to the invention, the characteristics set out in patent claim 1. As described in this invention, the emptying arrangement for emptying a flexible container is, on the other hand, to have the characteristics according to patent claim 5. The corresponding, dependent patent claims given hereinafter set out appropriate further developments and variants of the invention that further improve its functionality.

In the present invention, "flexible container" means a flexible transport holder that internally comprises one or more bag-like containers. In turn, the wall design of such a bag-like container can comprise one or more layers of material. At its upper end, the container has a top opening that can, for example, be provided with a filling valve or other appropriate connection organ; and, at its lower end, a bottom opening that can, in turn, be provided with, for example, a bottom valve for emptying the container.

Additionally, in the following description, the terms "above", "over", "below", etc. relate to directions in relation to the emptying arrangement for emptying a flexible container; or, its design details as they are shown in the attached figures.

In general, the invention relates to a solution for improving and accelerating the emptying of a flexible container of therein stored or transported fluid, or thereto comparable products. Such materials generally have a viscosity varying from very liquid to viscous. The viscosity of such materials typically ranges between 1 and 10,000,000 mPa·s. On the other hand the physical characteristics of the materials can also be such that the materials do not demonstrate a normally measurable viscosity, but can be displaced via the influence of an external force. These various types of materials are hereinafter covered by the term "bag contents".

Use of the method and arrangement according to the present invention offers several significant advantages over the prior art solutions. Thus, with relatively simple design solutions, it is possible to obtain an almost complete emptying of the flexible container.

A disadvantage of current emptying arrangements is that they require the flexible container to have a certain amount of loose bag material before the container can be subjected to the emptying arrangement in question. Current emptying arrangements thus require the container to have been emptied of a certain quantity of its contents before the emptying arrangement in question can be applied to the container at all. When using the present invention, on the other hand, the flexible container can be immediately placed in the emptying arrangement. This makes the emptying process both faster and less labour-demanding.

The present invention achieves a constant pressure in the flexible container, this noticeably simplifying use of a pump apparatus for accelerating emptying of the container.

In known solutions that use rollers to empty the flexible container, the rollers only act on a given line of the container for a fraction of the emptying time. In a method according to the present invention, the container is continuously acted on owing to the twisting change of shape the container is subjected to.

The present invention and present method are also easy to use. When the container is placed in the arrangement, the gripping apparatus is centred over the flexible container, it then being possible for the emptying process to proceed automatically.

Further advantages and details of the inventions are more closely set out in the description below.

SUMMARY OF DRAWING FIGURES

In the following, the invention is described more closely with references to the attached drawings, in which.

PREFERRED EMBODIMENT

The above-mentioned figures do not show the present emptying arrangement for emptying a flexible container to scale, their sole purpose being to illustrate the preferred embodiments' design solutions and the functions of these embodiments. In this connection, the individual design elements that are each shown and labelled with a reference number in the attached figures correspond to the design solutions presented, with corresponding reference numbers, in the description given below.

Figure 1:
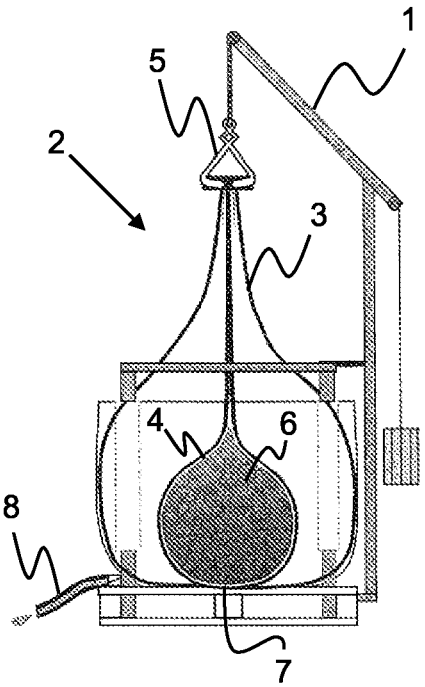
FIG. 1 PRIOR ART
FIG. 1 shows, as a vertical section, a per se known arrangement for stretching a flexible container when it is being emptied.
Figure 2:
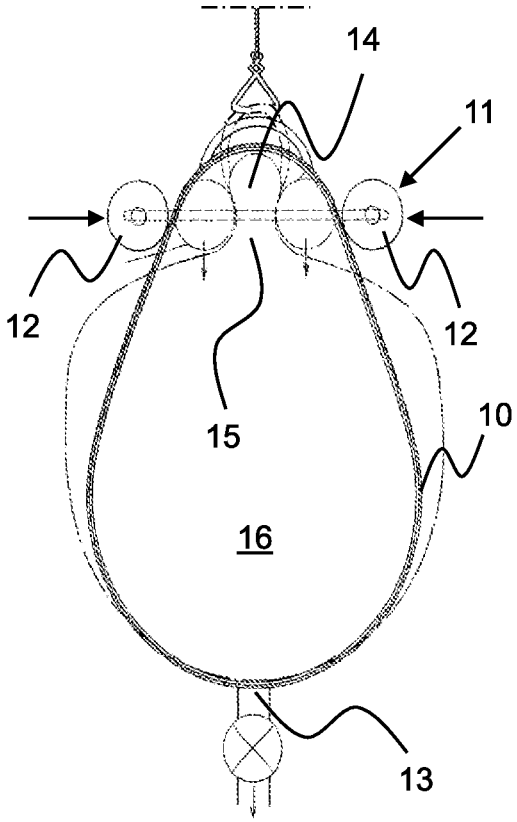
FIG. 2 PRIOR ART
FIG. 2 shows, as a vertical section, a per se known roller apparatus for use when emptying a flexible container.
Figure 3:
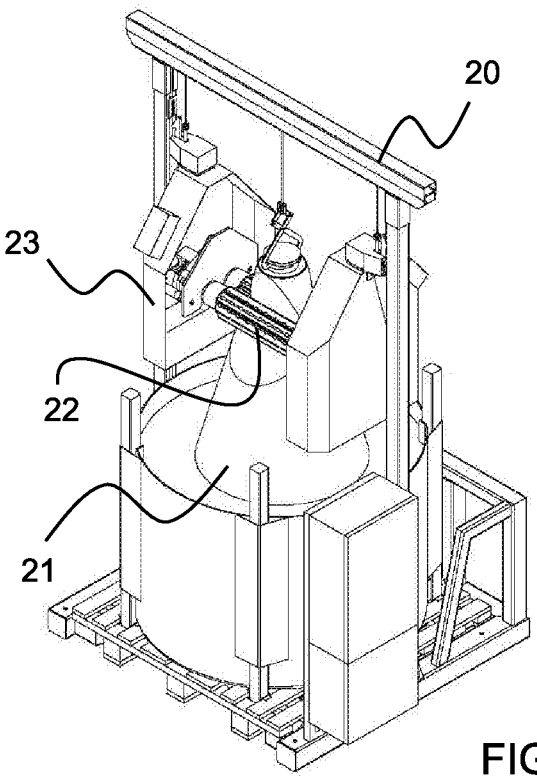
FIG. 3 PRIOR ART
FIG. 3 shows, as an axonometric representation, a per se known roller apparatus for use when emptying a flexible container.

FIGS. 1, 2 and 3 show known solutions used for emptying flexible containers. The vertical section in FIG. 1 shows an arrangement 1 for stretching a flexible container 2 when it is being emptied. In the figure, the container's outer protective sheath 3 and inner transport bag 4 can be distinguished. To empty the container, its upper end is held via a lifting hook 5 or similar tool, the container then being stretched in a vertical direction. In this stretching, the container is subjected to lateral constriction, the bag contents 6 being thereby pressed out of the transport bag through a bottom opening 7, which is essentially at the bottom end, and then through any thereto disposed discharge spout 8.

FIG. 2 shows a flexible container 10, which can advantageously be stretched in an arrangement as per FIG. 1, provided with a per se known roller apparatus 11. Such a roller apparatus acts on the flexible container via the rollers 12, which lie opposite to each other, being displaced towards each other by a special displacement device (not shown). While the rollers are being horizontally pressed against the container, the roller apparatus also exerts pressure vertically, either through the rollers' own weight or through an active displacement applied to the roller apparatus in a vertical direction oriented towards the bottom opening 13 in, or made in, the container.

However, as shown in FIG. 2, the rollers 12 cause a bubble 14 to form above the rollers' towards each other oriented nearest surfaces. As the roller apparatus cannot fully seal the passage 15 between the rollers, some of the bag contents 16 always escape into this bubble and thus avoid being pressed out of the container.

In a known emptying arrangement as per FIG. 3, essentially the same main design elements as in the solutions described above can be distinguished. Thus, there can be seen a stretching apparatus 20 to stretch the flexible container 21, the roller apparatus here being replaced by toothed rollers 22 for exerting a pressure against the flexible container's opposing wall surfaces. This design has a roller apparatus where, in turn, the tops of the teeth of one of the rollers bottom in the recesses of the opposing roller. The nip formed in this way between the adjacent rollers largely prevents the bag contents in the container from escaping to the wrong side of the rollers. Despite this design, there is some leakage and a coating remains on the inside surface of the transport bag.

Figure 4:
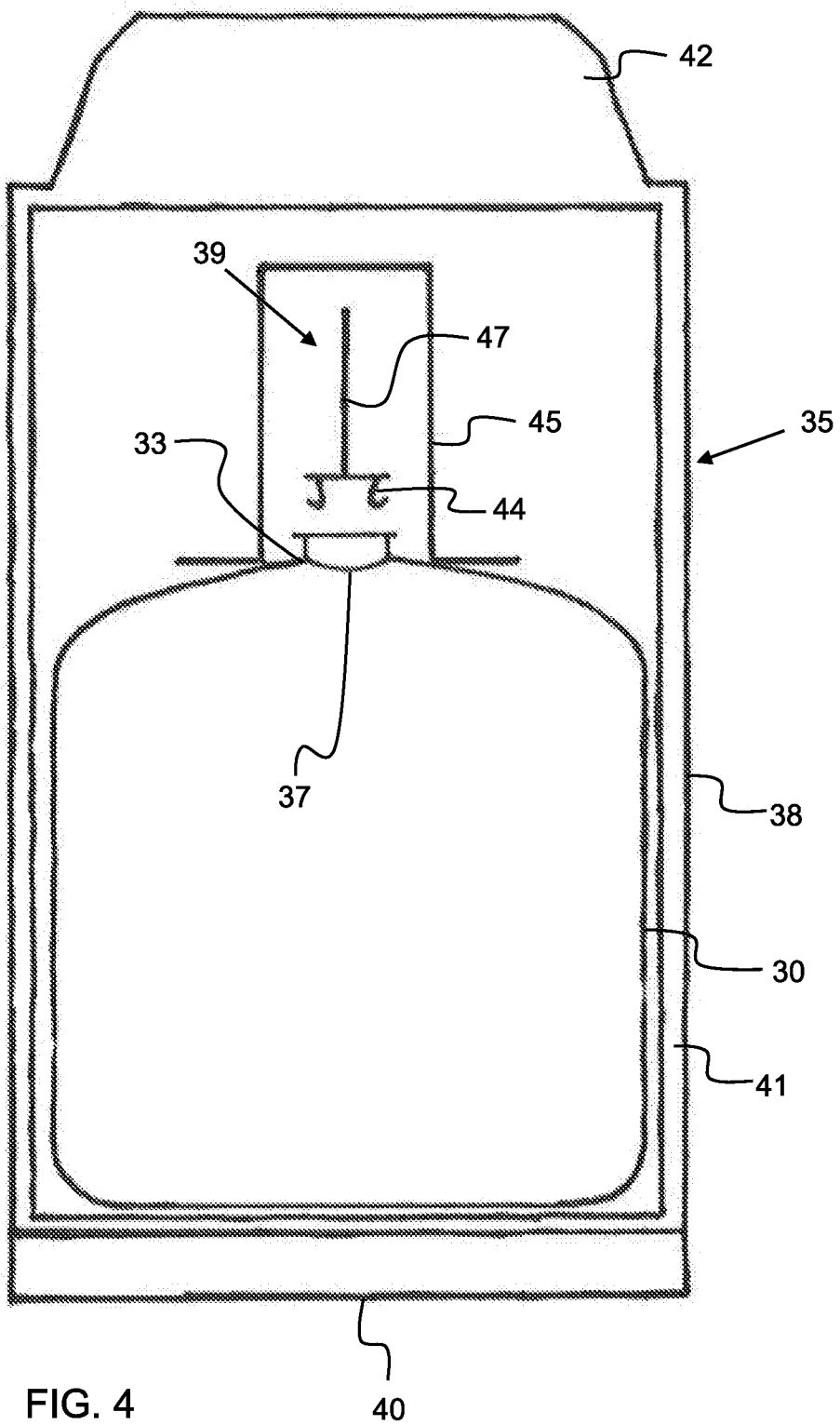
FIG. 4 shows an emptying arrangement as per the present invention.
Figure 5:
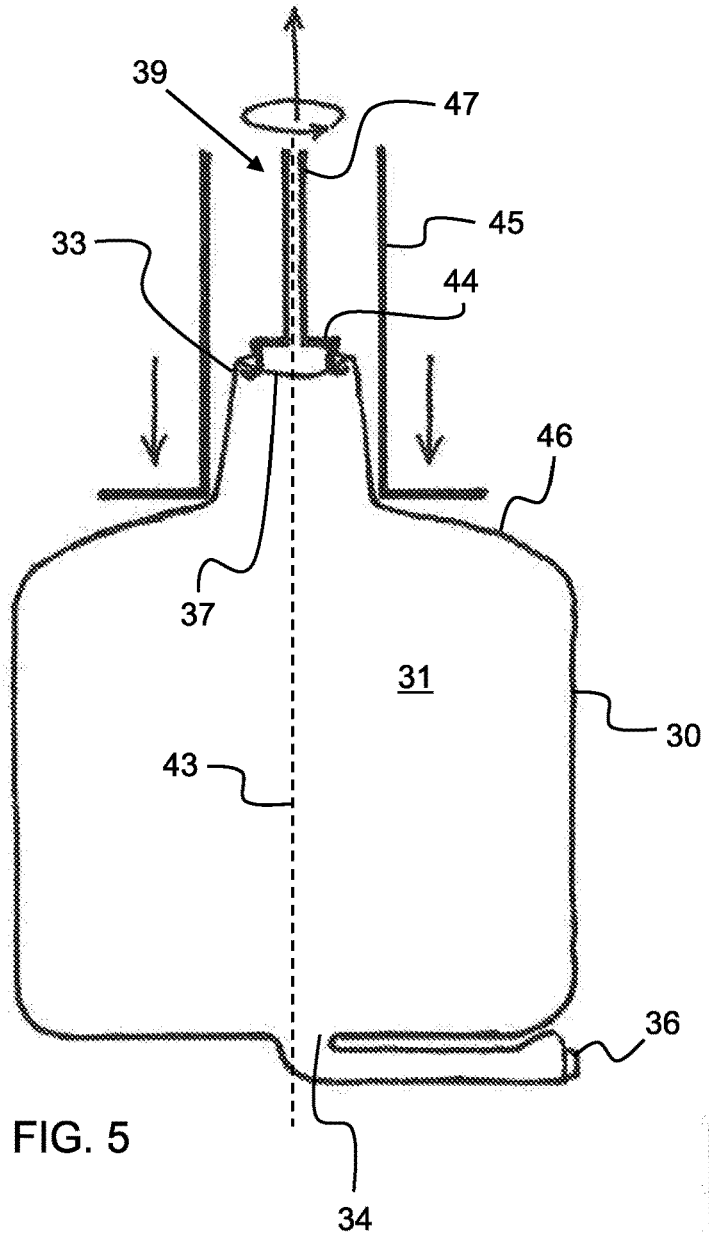
FIG. 5 shows a vertical cross section of an emptying arrangement as per FIG. 4; and, FIG. 6 shows, schematically, the progress of the emptying process.
Figure 6:
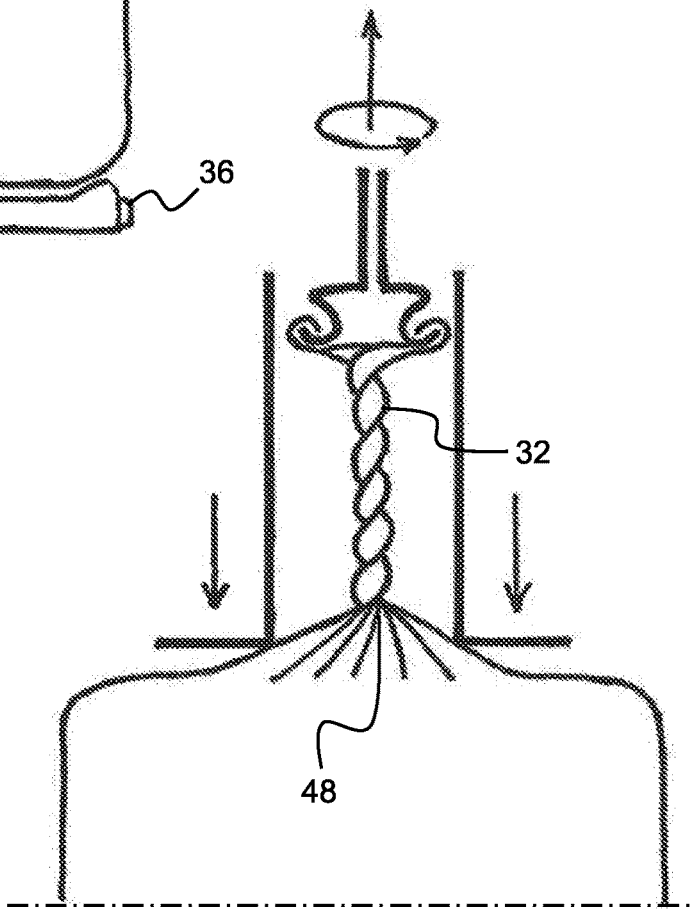

Thus, to further increase the efficiency of emptying a flexible container 30, a method and arrangement has been developed which is here described with reference to the present embodiment as shown in FIGS. 4, 5 and 6 where the container is subjected to a turning motion. Through such turning, the container is gradually and increasingly subjected to constriction, thereby simultaneously forcing the bag contents 31 stored in the container out of this latter. As the flexible container twists together owing to the turning movement, a tightly wound string 32 forms and advances from the container's upper end 33 towards the bottom opening 34 in the container. The string 32 prevents the bag contents 31 finding their way to the container's upper end. Instead, bag contents are essentially pressed away by the twisting of the container's walls.

The present emptying arrangement 35 works as follows.

The per se known flexible container 30 with bag contents 31 is placed in an emptying arrangement 35 according to FIG. 4. In its lower end, the flexible container includes a bottom opening 34 and/or a bottom valve 36. In its upper end 33, the flexible container further provides a top opening 37 and/or a connection organ. The flexible container is placed in the emptying arrangement in such a way that the container's bottom opening 34 is below the top opening 37—cf. FIG. 5. The emptying arrangement has a framework 38 that positions a turning apparatus 39 above the flexible container. The emptying arrangement can also advantageously be equipped with a bottom structure 40, protective walls 41, a protective door (not shown) and a roof structure 42 that, together, largely surround the flexible container (cf. FIG. 4).

By turning the flexible container around an axis of rotation stretching from the top opening 37 to the bottom opening 34 and which, in FIG. 5, coincides with the container's imaginary vertical centre axis 43, the bag contents 31 are removed from the flexible container 30 via at least one bottom opening 34 in, or made in, the container. To carry out this turning, said turning apparatus 39 is attached to the container's upper end 33 via at least one fastening array 44 provided by the turning apparatus and disposed to form an essentially rigid connection with the container's upper end.

In the first phase of operation, the flexible container 30 is stretched and, outside the fastening array 44, a restraint 45 is applied against the container's upper surface 46, the fastening array thereby being arranged to rotate in relation to said restraint. To be continuously in contact with the container, the restraint can advantageously be displaceable in a direction parallel to the turning apparatus's axis of rotation, which itself can advantageously be coincident with the container's centre axis 43.

The fastening array 44 is essentially fixed rigidly to a shaft 47 that can be made to rotate via, for example, a therewith directly or indirectly operating motor or some other per se known turning device. Via the fastening array, rotation of said shaft is thus propagated to the flexible container 30 and a turning of the container around the axis of rotation is thereby commenced. Hereby, the turning is directed towards that part of the container between the fastening array applied to the upper end 33 of the container 30 and that part of the container's upper surface 46 that, owing to the friction between the container's upper surface and the restraint 45, is held essentially stationary by said restraint. As a result of the turning, that part of the container over the restraint's contact point is gradually twisted into the tight string (32) shown in FIG. 6.

The string 32 formed by the twisting of the container 30 forms a barrier 48 that essentially prevents a flow of the bag contents 31 to the twisted part of the container from that part of the container that has not yet reached the restraint 45.

By preventing a flow of materials to the twisted part of the container 30, an inner pressure simultaneously builds in the bag contents 31 in that part of the flexible container between the bottom opening 34 and the restraint 45. With the continued turning of the container, the twisted string 32 works its way downwards, along the axis of rotation, towards the bottom opening. The thereby arising increased pressure accelerates emptying of the flexible container.

The above describes how the fastening array 44 grips the flexible container 30 and directs a turning motion to the container so that this latter is twisted into a string 32. As the flexible container can comprise one or more bag-like containers arranged inside each other, there are different variations of how connection between the fastening array and the container can be effected.

In embodiments where the flexible container 30 comprises only one bag-like container with a connection organ as described above, the fastening array 44 can grip said organ or, similarly, the container's wall next to this organ. As per the above-described principles, emptying of the container is then effected by gradually twisting the container into a string 32.

In embodiments where the flexible container 30 comprises several bag-like containers arranged within each other, the outer so-called protective sheath often has a collar structure around the top opening 37. In such embodiments, the fastening array 40 can advantageously be attached to the protective sheath's collar structure so as to form an essentially stiff connection with this collar structure. When gradual twisting of the protective sheath now commences, rotation in the shaft 47 of the emptying arrangement 35 is propagated, via the fastening array 44, to the flexible container's protective sheath and a turning of the protective sheath around its vertical axis begins. Hereby, the turning is directed towards that part of the protective sheath between the fastening array attached to the collar structure and that part of the protective sheath held stationary by the restraint 45, which latter is pressed against the upper surface 46 of the protective sheath. Owing to the friction between the protective sheath and the bag-like container(s) it surrounds, the turning is also propagated to the inner containers, these being hereby also twisted around their axes of rotation, the protective sheath and inner container(s) thus being twisted together in a tight string.

The pressure that the turning engenders in the flexible container 30 depends on, amongst other things, the speed of turning and the viscosity of the bag contents 31 in the container.

The description above and the therein cited figures are intended solely to give an overview of the present solution for the design of an emptying arrangement for emptying a flexible container and the use of a method for emptying this container. Thus, the solution is not limited solely to the embodiment described above or in the attached patent claims. Indeed, within the idea described in the attached patent claims, several variations or alternative embodiments are possible.

The invention claimed is:

1. A method for emptying a flexible container (30) of a bag contents (31) therein, said flexible container comprising a bottom opening (34) in its lower end and a top opening (37) in its upper end (33), the method comprising the steps of:

placing the flexible container including the contents (31) thereof in an emptying arrangement (35) in such a way that the container's bottom opening (34) is below the top opening (37), attaching a turning apparatus (39) to the upper end (33) of the container via at least one fastening array (44), turning the flexible container (30) around an axis of rotation that unites the bottom opening (34) and the top opening (37), letting the turning motion gradually propagate from the container's upper end (33) towards its lower end at the same time as the flexible container is twisted into a tight string (32), andremoving the bag contents (31) from the flexible container via the bottom opening (34) provided or made therein, whereby the method further comprises the steps of:

applying a restraint (45) to an exterior surface of the flexible container (30) at an upper end of the flexible container (30) such that essentially continuous contact between the restraint (45) and the flexible container ensures that the restraint prevents rotation of that part of the flexible container lying below the restraint; and rotating the fastening array (44) in relation to said restraint.

2. The method according to claim 1, characterized in that the turning apparatus (39) is applied to the top opening (37) of the flexible container (30), whereby a rotation is induced around a centre axis of the turning apparatus (39) to act upon the flexible container.

3. The method according to claim 2, characterized in that said fastening array forms an essentially rigid connection with the flexible container.

4. An emptying arrangement (35), which emptying arrangement is disposed to receive a flexible container (31) comprising a bottom opening (34) in its lower end and a top opening (37) in its upper end (33), whereby said flexible container being disposed within the emptying arrangement such that the flexible container's bottom opening (34) lies below the top opening (37), and the emptying arrangement (35) comprises a turning apparatus (39) to be applied to the top opening (37) of the flexible container (30) using at least one fastening array (44) provided by the turning device, said array being so disposed to form an essentially rigid connection with the flexible container, the turning apparatus being arranged to turn the flexible container (30) around an axis thereof uniting the top opening (37) and the bottom opening (34), as to empty the flexible container of bag contents (31), characterized in that the turning apparatus (39) comprises a restraint (45) that is applied against an exterior surface of the flexible container (30) at an upper end of the flexible container (30), the restraint hereby being arranged to keep the upper end of the flexible container essentially stationary relative the turning fastening array (44).

5. The emptying arrangement according to claim 4, characterized in that the fastening array (44) is fixed essentially rigidly to a shaft (47) disposed to be brought into rotation by a therewith operating motor.

6. The emptying arrangement according to claim 4, characterized in that the restraint (45) is displaceable in a direction parallel to the centre axis of the turning apparatus (39).

7. The emptying arrangement according to claim 4, characterized in that the emptying arrangement (35) comprises protective walls (41), a protective door and roof structure (42) to surround the therein disposed flexible container (30).

* * * * *